United States Patent [19]

Boergerding et al.

[11] Patent Number: 4,897,168

[45] Date of Patent: Jan. 30, 1990

[54] PROCESS AND ARRANGEMENT FOR PRODUCTION OF PRINTING PLATE SUPPORT

[75] Inventors: Heinz Boergerding, Walluf; Joachim Stroszynski, Wiesbaden, both of Fed. Rep. of Germany

[73] Assignee: Hoechst Aktiengesellschaft, Frankfurt am Main, Fed. Rep. of Germany

[21] Appl. No.: 189,829

[22] Filed: May 3, 1988

[30] Foreign Application Priority Data

May 12, 1987 [DE] Fed. Rep. of Germany ..... 3715791

[51] Int. Cl.[4] ..... C25F 3/04

[52] U.S. Cl. ..... 204/129.43; 204/129.75; 204/DIG. 9; 204/129.5

[58] Field of Search ..... 204/129.4, 129.43, DIG. 9, 204/129.75, 33, 129.5

[56] References Cited

U.S. PATENT DOCUMENTS

| | | | |
|---|---|---|---|
| 2,755,238 | 7/1956 | Turner | 204/33 |
| 3,477,929 | 11/1969 | Mamikata et al. | 204/129.43 |
| 3,935,080 | 1/1976 | Gumbinner et al. | 204/33 X |
| 4,087,341 | 5/1978 | Takahashi et al. | 204/129.43 |
| 4,301,229 | 11/1981 | Sakaki et al. | 204/129.4 X |
| 4,502,925 | 3/1985 | Walls | 204/33 |
| 4,714,528 | 12/1987 | Takeuchi et al. | 204/33 |

*Primary Examiner*—Donald R. Valentine

*Attorney, Agent, or Firm*—Foley & Lardner, Schwartz, Jeffery, Schwaab, Mack, Blumenthal & Evans

[57] ABSTRACT

The present invention relates to a roughened printing plate support of aluminum or an alloy thereof, which shows equally distributed tubular depressions. Furthermore, a process for the production of the printing plate-support is disclosed, in which roughening is performed in an acidic electrolyte by means of a pulsed direct current. The invention also relates to arrangements which are suitable for carrying out the process.

7 Claims, 3 Drawing Sheets

PROCESS AND ARRANGEMENT FOR PRODUCTION OF PRINTING PLATE SUPPORT

BACKGROUND OF THE INVENTION

The present invention relates to a roughened printing plate support and also to a process and an arrangement for the production of this support.

For the production of printing plates, the metallic supports which are preferably comprised of aluminum or an alloy thereof, are usually roughened. According to the state of the art, roughening of such support sheets is carried out mechanically, for example, by grinding with an abrasive agent or by brushing; chemically, for example, using an acid; or electrochemically in electrolyte solutions. The prior art also discloses a combination of the abovedescribed processes. In the electrochemical roughening process, an asymmetrical alternating current or, preferably, a sinusoidal alternating current is, for example, employed and the electrolyte, e.g., hydrochloric acid or nitric acid, the concentration of the electrolyte, the current density, the temperature and other parameters can be varied, such that different surface structures are obtained.

However, the use of a sinusoidal alternating current does not produce optimum results with respect to current action and current yield, because the halfwaves are symmetrical.

SUMMARY OF THE INVENTION

It was therefore an object of the present invention to provide a roughening process for use in the production of printing plates, which does not give rise to the disadvantages of the hitherto known processes, in view of printing quality.

In accordance with these and other objects of the invention, there is provided a roughened support material for printing plates, comprised of aluminum or an alloy thereof, wherein the material comprises equally distributed tubular depressions and has a bright surface. A process is provided for the production of this roughened support material comprising electrochemically roughening the material in an acidic electrolyte.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DESCRIPTION OF PREFERRED EMBODIMENTS

Printing plate supports according to the invention comprise aluminum or an alloy thereof having equally distributed tubular depressions and bright surfaces. The depressions produced are free from loose layers. Good printing qualities are achieved by using the printing plates according to the invention when they are coated with light-sensitive layers, exposed and developed.

The present invention also provides a process for roughening printing plate supports for use in the production of printing plates that are coated with light-sensitive layers, exposed and developed.

The process is based on an electrochemical roughening procedure—optionally followed by anodic oxidation—for plates of aluminum or an alloy thereof in acidic electrolytes known in the art. In the process, roughening is performed by means of a pulsed direct current. The process can be carried out as a two-stage process, using electrolytes of different compositions in each stage and symmetrically adjusting the parameters of the current inputs and outputs. In a variation of the process, a contact method is employed.

European Patent Application No. 0,054,990, the contents of which are hereby incorporated by reference, discloses the use of a pulsed direct current for etching capacitor films. It was, however, surprising to find that a process of this kind is also suitable for use in the production of printing plate supports, since different prerequisites, which are known per se, are of importance in the production of printing plates and capacitors, for example, on the one hand, adhesion towards the light-sensitive layer and printing quality (e.g., prevention of scumming) and, on the other hand, capacitance conditions.

According to the invention in an arrangement for carrying out the process, poled electrodes are arranged in one or several electrolyte baths.

Figure 1A:
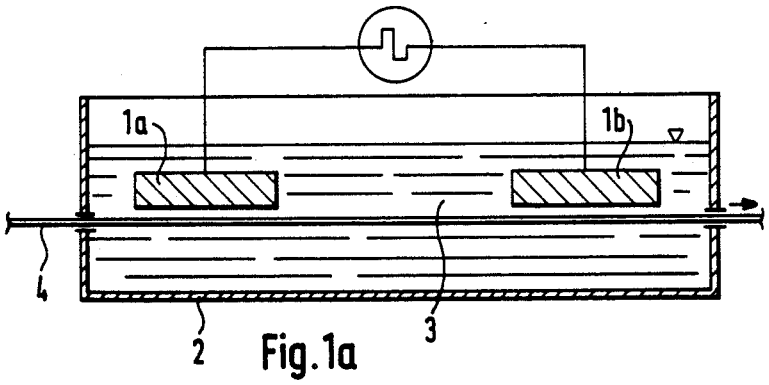
FIG. 1*a* shows, in a schematic lateral view, an arrangement comprising two electrodes (1*a*, 1*b*) which are disposed in the trough (2) containing the electrolyte (3). The web (4) is arranged beneath the electrodes.
Figure 1B:
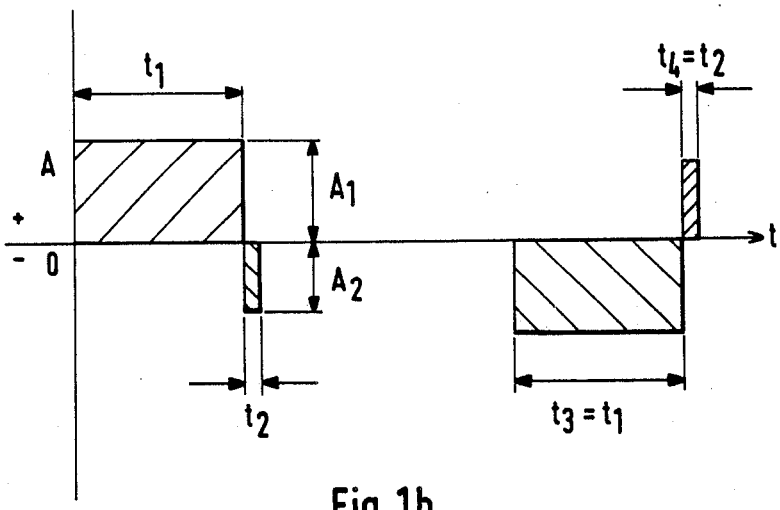
FIG. 1*b* shows the direct current adjustment (A) as a function of times (t).

In a first embodiment, shown in FIG. 1, two electrodes (1*a*, 1*b*) are disposed in trough (2) containing the electrolyte (3). The web (4) is arranged beneath the electrodes.

Figure 2A:
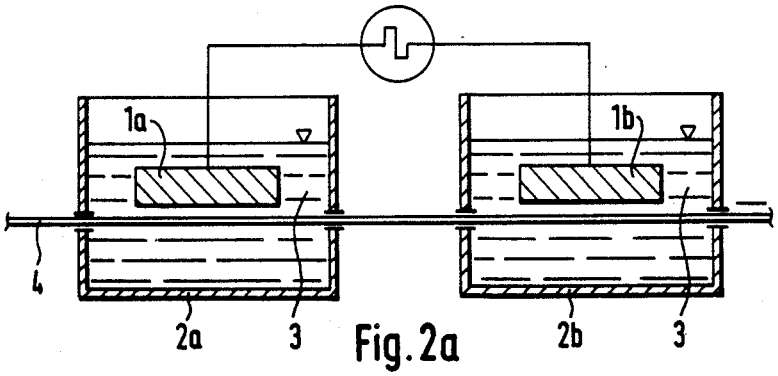
FIG. 2*a* shows an arrangement corresponding to FIG. 1 but in this case the electrodes (1*a*, 1*b*) are disposed in two troughs (2*a*, 2*bl* ).
Figure 2B:
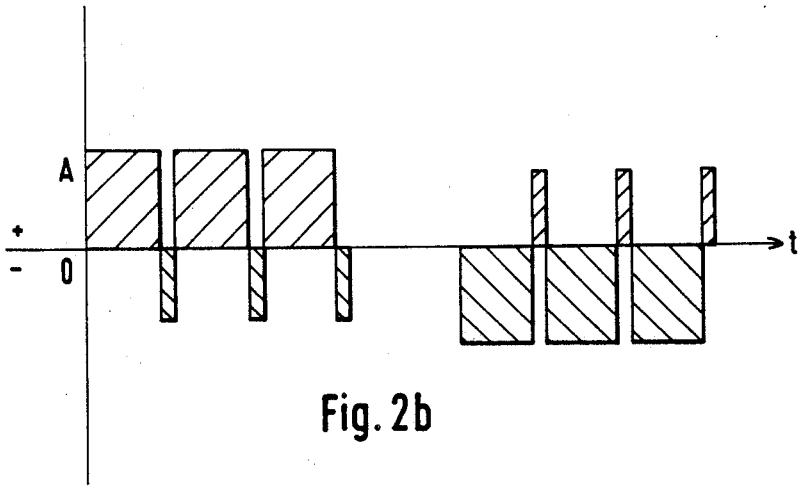
FIG. 2*b* shows the respective direct current adjustment.

In a second embodiment, shown in FIG. 2, electrodes 1*a* and 1*b* are disposed in separate troughs (2*a* and 2*b*, respectively). The web (4) is arranged beneath the electrodes.

Figure 3A:
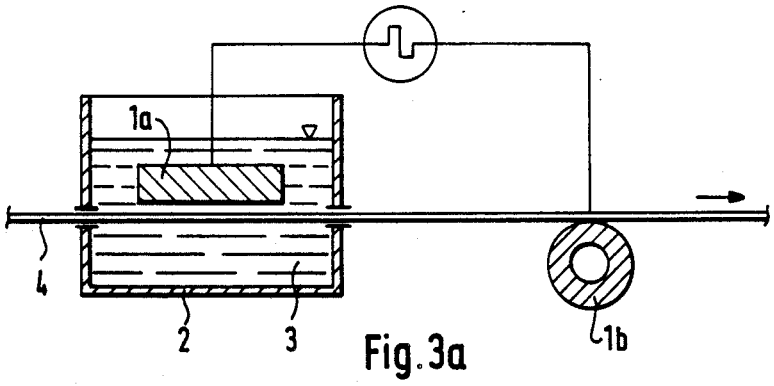
FIG. 3*a* shows, in a schematic lateral view, an arrangement for carrying out the contact method. The trough (2) contains the eletrolyte (3). Inside the trough (2). the electrode (1*a*) is arranged above and at a distance from the web (4) and, outside the trough (2), the electrode (1*b*) (shown as a roll electrode) is in contact with the web (4).
Figure 3B:
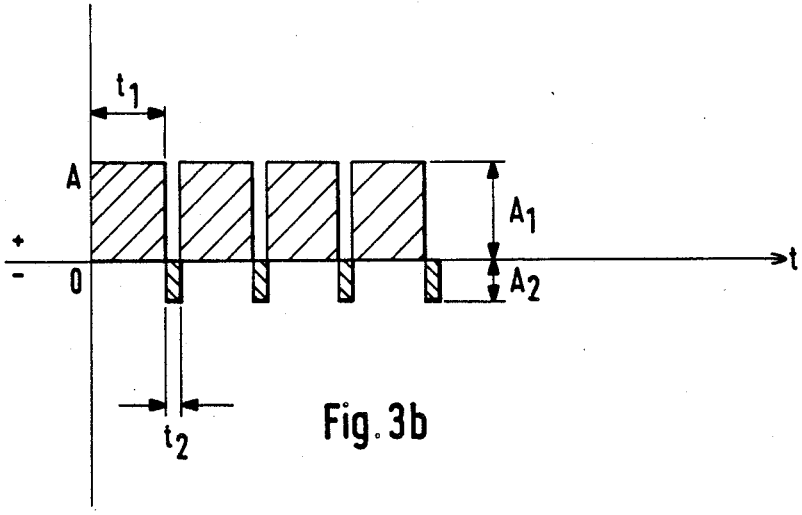
FIG. 3*b* shows the direct current adjustment (A) as a function of times (t).

In a third embodiment, the contact method (illustrated in FIG. 3), an arrangement is used which has the characterizing feature that one electrode (1*b*) is disposed outside the electrolyte bath and is in direct contact with the web to be treated, while the other electrode(s) (1*a*) is/are arranged in the electrolyte bath(s) (3). The electrodes which are present in the electrolyte(s) are preferably arranged at a distance of 2 to 25 mm from the web to be treated. The electrode 1*b* can be, for example, a roll electrode.

The arrangements and the corresponding direct current adjustments are shown in the accompanying figures, which are, however, not intended to be limitative.

What is claimed is:

1. A process for the production of a roughened support material for printing plates, comprising aluminum or an alloy thereof, wherein said material further comprises equally distributed tubular depressions and has a bright surface, which comprises the steps of electrochemically roughening said material, in at least two sequentially arranged acidic electrolyte baths using electrolytes of different compositions, by means of a pulsed direct current.

2. A process as claimed in claim 1, further comprising the step of symmetrically adjusting the parameters of the said pulsed direct inputs and outputs.

3. A process for the production of a roughened support material for printing plates, comprising aluminum or an alloy thereof in the form of a web, wherein said material further comprises equally distributed tubular depressions and has a bright surface, which comprises the step of electrochemically roughening said material in an acidic electrolyte by means of a pulsed direct current, wherein at least one electrode is arranged in at least one electrolyte bath, while one electrode is disposed outside said electrolyte bath or baths and is in direct contact with said material.

4. An arrangement for carrying out the process as claimed in claim 3, wherein said web is passed through at least one trough containing an electrolyte, an electrode is arranged in said eletrolyte, at a small distance from said web, and a corresponding electrode contacts said web outside said trough.

5. An arrangement as claimed in claim 4, wherein said electrode outside said trough has the form of a roll electrode.

6. An arrangement for carrying out a process for the production of a roughened support material for printing plates, comprising aluminum or an alloy thereof in the form of a web, wherein said material further comprises equally distributed tubular depressions and has a bright surface, said process comprising the step of electrochemically roughening said material in an acidic eletrolyte by means of a pulsed direct current, wherein said web is passed through at least one trough which contains an electrolyte and wherein at least one electrode is arranged at a small distance from said web.

7. An arrangement as claimed in claim 6, wherein said electrode or electrodes arranged in said electrolyte are arranged at a distance of 2 to 25 mm from said web.

* * * * *